US005971293A

United States Patent [19]

Proietti

[11] Patent Number: 5,971,293

[45] Date of Patent: Oct. 26, 1999

[54] MODULAR SYSTEM WITH DOUBLE VENTILATION—MECHANIC AND THERMIC—FOR THE REDUCTION OR ANNULMENT OF THE FORMATION OF FOG BANKS

[76] Inventor: Luigi Proietti, via America Latina, 8 - 03100 Frosinone, Italy

[21] Appl. No.: 08/836,715

[22] PCT Filed: Oct. 15, 1996

[86] PCT No.: PCT/IT96/00191

§ 371 Date: May 13, 1997

§ 102(e) Date: May 13, 1997

[87] PCT Pub. No.: WO97/14851

PCT Pub. Date: Apr. 24, 1997

[30] Foreign Application Priority Data

Oct. 17, 1995 [IT] Italy ..... FR95A0007

[51] Int. Cl.[6] ..... A01G 15/00

[52] U.S. Cl. ..... 239/14.1; 239/2.1

[58] Field of Search ..... 239/2.1, 14.1

[56] References Cited

U.S. PATENT DOCUMENTS

| | | | |
|---|---|---|---|
| 2,570,226 | 10/1951 | Geiringer . | |
| 2,815,982 | 12/1957 | Bleamaster | 239/14.1 |
| 3,501,096 | 3/1970 | Stillwell et al. | 239/14.1 |
| 3,534,907 | 10/1970 | Bellis | 239/2.1 |
| 3,598,313 | 8/1971 | Attmer | 239/14.1 X |

FOREIGN PATENT DOCUMENTS 4115476 10/1991 Germany .

OTHER PUBLICATIONS

*Roads and Road Construction,* vol. 33, No. 3, Mar. 1995, Sutton GB, p. 85 XP002024039 "Turnpike Fog and Smoke Detector."

*Primary Examiner*—Andres Kashnikow
*Assistant Examiner*—Robin O. Evans
*Attorney, Agent, or Firm*—Smith, Gambrell & Russell, LLP; Beveridge, DeGrandi, Weilacher & Young

[57] ABSTRACT

The modular system with double ventilation—mechanic and thermic—for the reduction or annulment of the formation of fog banks, that determines the slowest possible cooling of the ground and of the adjacent air layers maintaining their temperature higher than the steam condensation one, comprises an internal combustion engine (1) for the production of mechanic and thermic energy to be used for heating the soil as well as the movement of the air masses above; a plurality of propellers (2) of different dimensions for opposing the phenomenon of the thermic reversal that occurs in the night, when the warm air rises to the higher layers, while the cold air moves down to the lower ones; and a pipe system (3) for heat dispersion which acts as a radiator and in the same time produces an ascensional current of warm air that pushes into the higher layers the fog possibly formed.

6 Claims, 1 Drawing Sheet

Figure 1:
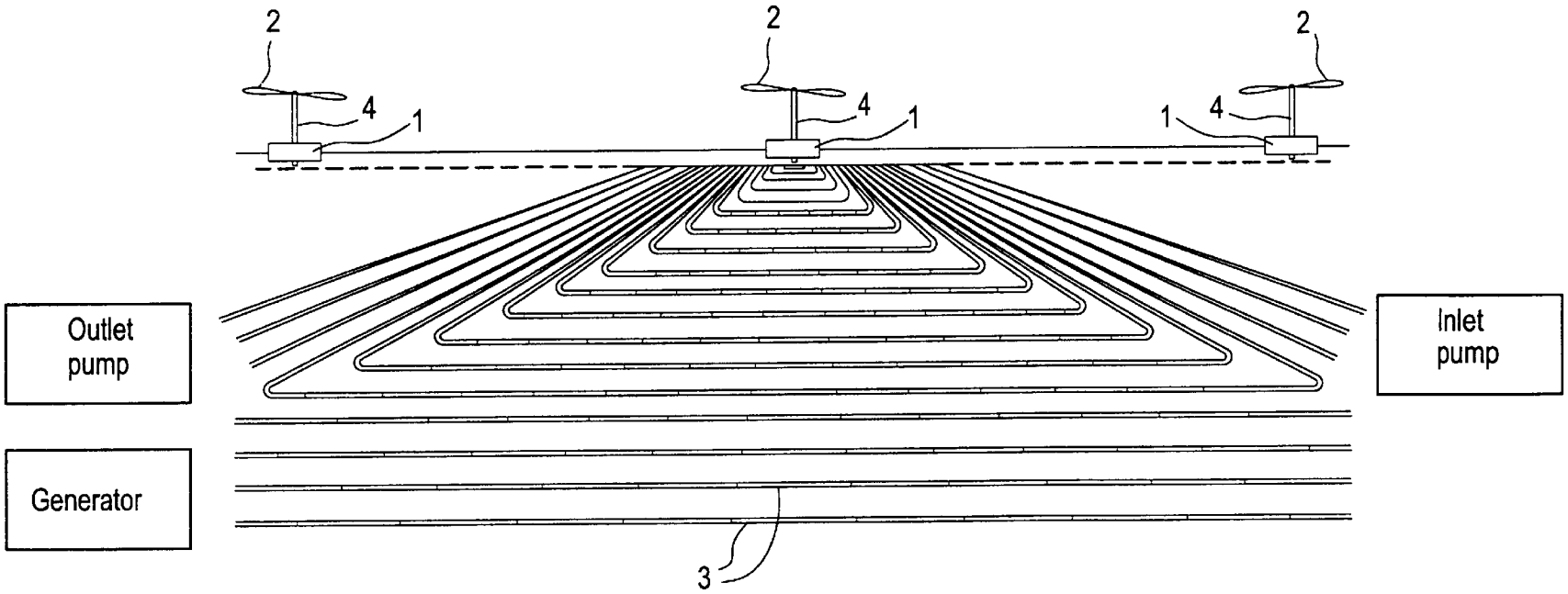

MODULAR SYSTEM WITH DOUBLE VENTILATION— MECHANIC AND THERMIC— FOR THE REDUCTION OR ANNULMENT OF THE FORMATION OF FOG BANKS

The present invention concerns a modular system with double ventilation—mechanic and thermic—for the reduction or annulment of the formation of fog banks on small and wide areas, that will prevent the quick cooling of the soil.

It is known that fog is a low cloud that touches the level of the ground, and that is produced when moist air gets into contact with a soil at a low temperature, and the steam contained in it is condensed. In particular, "radiation fog" is the one that gets formed after sunset, when the soil is cooled by radiation, with a consequent lowering of the temperature of the air layer immediately above; while "condensation fog" is the one created by a warm and moist air current that touches a cooler ground. The phenomenon of the "fog" therefore has as a common denominator the cooling of the lower layers of the soil.

"Wind" means the natural movement of the air produced by periodic or accidental variations of the barometric pressure from the higher to the lower pressure, due to temperature variations, and there are three kinds of ventilation: natural—with the opening of doors and windows—, mechanic—produced by fans—and thermic, i.e. the one produced by the movement of air masses caused by temperature differences.

It is the aim of the present invention to reduce or completely prevent the formation of fog banks by means of a system that determines the slowest possible cooling of the soil and of the adjacent air layers, keeping their temperature higher than the steam condensation one.

The aim set forth is reached by means of the system according to the present invention, comprising three mechanic elements which exploit mechanic and thermic energy for producing two of the three above mentioned ventilation kinds—mechanic and thermic—for dissipating the fog, and which furthermore exploit the possibility—given by a radiator—of preventing the formation of said fog, making the ground cool down the slowest possible, or rather trying to keep it at a constant temperature.

The system according to the present invention—in its modular or multi-modular variants—may be applied in sports plants (sports grounds, stadium, cycle-tracks), laying underground said radiator; said system may also be used in airports, ports, speedways or speedway turn-offs, or wherever fog is an endemic phenomeon. A wider application field may be projected in agriculture, in plantations and similar.

The present invention will be described more in detail hereinbelow relating to the enclosed FIG. 1 in which an embodiment of the same is shown.

The figure shows a modular system with double ventilation—mechanic and thermic—for the reduction or annulment of the formation of fog banks, comprising mechanic means that keep the soil temperature above the condensation temperature of the steam, and consisting of:

an internal combustion engine 1 for the production of mechanic and thermic energy to be used for heating the soil as well as the movement of the air masses above;

a plurality of propellers 2 of different dimensions for opposing the phenomenon of the thermic reversal that occurs in the night, when the warm air rises to the higher layers, while the cold air moves down to the lower ones;

a pipe system 3 for heat dispersion which acts as a radiator and in the same time produces an ascensional current of warm air that pushes into the higher layers the fog possibly formed; the geometric shape of said pipes of the radiator may be varied according to the different needs.

For what concerns the realization of the system according to the present invention, said internal combustion engine 1 with variable power has its motive power point connected with a joint that moves a blade or propeller 2, placed on a tower 4 of a determined height, onto a support that may perform a rotation of 180° or 360°, with a determined number of revolutions per minute. In general, a power of 30 HP is considered for covering an area of one hectare. The use of the fan has the purpose of opposing the phenomenon of the thermic reversal that occurs during the night, when the warm air rises towards the higher layers which the cool air comes down towards the lower ones. The fundamental function of the fan is exactly the one of mixing the two layers, producing a temperature increase in the lower areas.

It has been seen from experiences that the best results are obtained moving a considerable quantity of air at a constant low speed. The water cooling system of the internal combustion engine according to the present invention is connected with a system of heat dispersion metal pipes 3 that form the radiator and that are laid underground and apart from one another from one to five meters, with a centrifugal outlet pump and a centripetal inlet pump, for the circulation of the cooling water. Considering that the engine gets heated due to the internal combustion that takes place in the cylinders, and that the temperature of the gases in the cylinder exceeds 1.500° C., whereby the water circulates in contact with the cylinders by means of hydraulic pumps and a thermostat, a constant temperature between 80° C. and 100° C. may be maintained in the whole pipe system, forming the radiator; what it more, said temperature is optimal for the good working and efficiency of the engine, as well as for maintaining constant the temperature of the soil by forming an ascensional current of warm air that pushes the fog, that may have been formed, into the upper layers of the air.

The mechanic modular system engine-blade-radiator may be used for small areas or about one hectare; by a series connection of two or more, greater surfaces may be served.

It is suggested to connect the whole multi-modular system for obtaining the greatest efficiency with the minimum of power.

The geometric shape of the pipes of the radiator may be varied according to the different requests, still maintaining above described functioning.

In a less expensive variant of the system according to the present invention, instead of said engine 1 a boiler with a burner may be applied in said system, with the same purposes.

For ecological purposes, a heat co-generator or generator may be provided for the discharge of waste.

In particular applications, said blades 2 mounted on towers 4, may be fed with electric current.

I claim:

1. A modular system with double ventilation—mechanic and thermic—for the reduction or annulment of the formation of fog banks on small and wide areas, that prevents the quick cooling of the soil, characterized in:

at least one of an internal combustion engine (1) or a boiler with a burner for the production of mechanic and thermic energy to be used for heating the soil as well as the movement of the air masses above;

a plurality of propellers (2) or blades of different dimensions for opposing the phenomenon of the thermic reversal that occurs in the night, when the warm air rises to the higher layers, while the cold air moves down to the lower ones;

a pipe system (3) for heat dispersion which acts as a radiator and in the same time produces an ascensional current of warm air that pushes into the higher layers the fog possibly formed.

2. A modular system with double ventilation, according to claim 1, characterized in that said engine (1) with variable power has its motive power point connected with a joint that moves one of said blades or propellers (2), placed onto a tower (4) of a determined height, onto a support that may perform a rotation of 180° or 360°, with a determined number of revolutions per minute, for opposing the phenomenon of the thermic reversal that occurs during the night, when the warm air rises towards the higher layers which the cool air comes down towards the lower ones, thus mixing the two layers, producing a temperature increase in the lower areas.

3. A modular system with double ventilation, according to claim 1, characterized in that said heat dispersion pipes (3) that form the radiator, are laid underground and have a centrifugal outlet pump and a centripetal inlet pump, for the circulation of the cooling water.

4. A modular system with double ventilation, according to claim 2, wherein the modular system includes the burner.

5. A modular system with double ventilation, according to claim 1, characterized in the presence of a heat co-generator or generator for the discharge of waste.

6. A modular system with double ventilation, according to claim 1, characterized in that said blades (2), mounted on said towers (4), are fed with electric current.

* * * * *